US008610369B2

(12) United States Patent
van der Veeken

(10) Patent No.: US 8,610,369 B2
(45) Date of Patent: Dec. 17, 2013

(54) ELECTRONIC CIRCUIT FOR DRIVING A FLUORESCENT LAMP AND LIGHTING APPLICATION

(75) Inventor: Renatus Willem Clemens van der Veeken, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 221 days.

(21) Appl. No.: 13/142,283

(22) PCT Filed: Dec. 11, 2009

(86) PCT No.: PCT/IB2009/055681

§ 371 (c)(1), (2), (4) Date: Jun. 27, 2011

(87) PCT Pub. No.: WO2010/076720

PCT Pub. Date: Jul. 8, 2010

(65) Prior Publication Data

US 2011/0266966 A1 Nov. 3, 2011

(30) Foreign Application Priority Data

Dec. 30, 2008 (CN) ..... 2008 1 0190298

(51) Int. Cl.
*H05B 37/02* (2006.01)

(52) U.S. Cl.
USPC ..... 315/291; 315/91; 315/239; 315/294

(58) Field of Classification Search
USPC ..... 315/91, 239, 291, 294
See application file for complete search history.

(56) References Cited

U.S. PATENT DOCUMENTS

| | | | | |
|---|---|---|---|---|
| 6,094,017 | A * | 7/2000 | Adamson | 315/307 |
| 6,380,692 | B1 * | 4/2002 | Newman et al. | 315/194 |
| 6,906,477 | B2 | 6/2005 | Kazanov et al. | |
| 7,109,665 | B2 | 9/2006 | Green | |
| 7,164,238 | B2 | 1/2007 | Kazanov et al. | |
| 7,339,331 | B2 | 3/2008 | Vanderzon | |
| 7,781,982 | B2 * | 8/2010 | Tatsumi | 315/291 |
| 2004/0100205 | A1 * | 5/2004 | Takahashi et al. | 315/248 |
| 2006/0125423 | A1 * | 6/2006 | Chitta et al. | 315/307 |
| 2010/0060179 | A1 * | 3/2010 | Newman et al. | 315/219 |
| 2010/0060186 | A1 * | 3/2010 | Taipale et al. | 315/291 |
| 2010/0060200 | A1 * | 3/2010 | Newman et al. | 315/307 |
| 2010/0264839 | A1 * | 10/2010 | Kurokawa | 315/224 |
| 2010/0289420 | A1 * | 11/2010 | Arai | 315/224 |

* cited by examiner

*Primary Examiner* — Jason M Crawford

(57) ABSTRACT

The present invention provides an electronic circuit for driving a fluorescent lamp from a periodic input voltage provided at a power input terminal. The circuit comprises an inverter for powering the fluorescent lamp, and a control unit. The control unit comprises a measuring input connected to the power input terminal for providing a synchronization signal representing a value of the periodic input voltage to the control unit, a control input for receiving an input signal representative of a desired lighting characteristic of the fluorescent lamp, and a control output connected to an enabling input of the inverter. The control unit is arranged to provide, via the control output, a control signal to the inverter to operate the inverter in synchronism with a periodicity of the synchronization signal representing the value of the periodic input voltage, the control signal being based on the input signal.

16 Claims, 3 Drawing Sheets

ELECTRONIC CIRCUIT FOR DRIVING A FLUORESCENT LAMP AND LIGHTING APPLICATION

FIELD OF THE INVENTION

The present invention relates to lighting applications using fluorescent lamps or the like. A fluorescent lamp is a gas-discharge lamp generally comprising a light bulb (also known as a burner) and an electronic circuit for starting the lamp. The electronic circuit generally comprises an inverter for providing an AC current to the lamp.

BACKGROUND OF THE INVENTION

At present, dynamic effects such as time-dependent dimming or color variation are being applied more and more in lighting applications. Fluorescent lamps may also be applied in such lighting applications. In order to provide dimming capabilities for such lamps, solutions have been proposed. Dimming of a fluorescent lamp can be accomplished by applying an electronic lamp driver enabled to drive the fluorescent lamp at a varying frequency, thereby providing a varying current to the lamp. Dimming is thus obtained by changing a switching frequency e.g. of a half-bridge circuit. The application of such an electronic lamp driver however is rather expensive due to the requirement of ICs to control the lamp driver. As fluorescent lamps having dimming capabilities are highly suited for domestic applications, the application of expensive components should be avoided. In addition, frequency-dimming methods such as PWM dimming, that are not synchronous with the e.g. 50 Hz (or the 100 Hz rectified) mains voltage, usually cause flickering when applied at low frequencies.

Instead of using an electronic lamp driver, it is known to start and power a fluorescent lamp (or light bulb) by using a self-oscillating inverter, e.g. a toroid inverter. Such inverters are known to be cheap compared to electronic lamp drivers. However, dimming by means of a frequency-dimming method cannot be applied in such a self-oscillating inverter. It is further known, e.g. from U.S. Pat. No. 6,380,692, to dim a lighting load by applying a controllable conductive device. Such a device (e.g. a TRIAC-based dimmer) provides a phase-cut AC voltage that can be applied for dynamically powering (e.g. enabling the intensity to be varied) certain lighting applications. A modified AC voltage, e.g. obtained as output voltage from a TRIAC-based dimmer, is not readily applicable for powering a fluorescent light bulb. In addition, the generation of the modified (e.g. phase-cut) AC voltage may require expensive high power electronic parts such as thyristors or TRIACs.

SUMMARY OF THE INVENTION

In view of the above-mentioned drawbacks, it is an object of the present invention to provide a comparatively inexpensive electronic circuit that facilitates the dimming of a fluorescent lamp.

According to an aspect of the invention, there is provided an electronic circuit for driving a fluorescent lamp from a periodic input voltage provided at a power input terminal, the circuit comprising an inverter for powering the fluorescent lamp;

a control unit comprising a measuring input connected to the power input terminal for providing a synchronisation signal representing a value of the periodic input voltage to the control unit;

a control input for receiving an input signal representative of a desired lighting characteristic of the fluorescent lamp, and a control output connected to an enabling input of the inverter, wherein, the control unit being arranged to provide, via the control output, a control signal to the inverter to operate the inverter in synchronism with a periodicity of the synchronisation signal representing the value of the periodic input voltage, the control signal being based on the input signal.

The electronic circuit according to the invention comprises an inverter for powering a fluorescent lamp (e.g. by providing a (high-frequency) alternating voltage). In order to achieve this, the electronic circuit can be provided, at a power input terminal of the circuit, with a periodic input voltage such as an AC voltage. The periodic input voltage can be received by the inverter (at its terminals) for, in operation, powering the fluorescent lamp. Prior to being provided to the inverter, the periodic input voltage can, if required, be rectified, e.g. by a full-bridge or half-bridge rectifier.

The electronic circuit further comprises a control unit that comprises a measuring input connected to the power input terminal for providing a synchronisation signal representing a value of the periodic input voltage to the control unit. Such a synchronisation signal can e.g. indicate a zero-crossing instance of the periodic input voltage, or indicate when a peak voltage is attained or when a predetermined voltage level is observed. In an embodiment, the electronic circuit comprises a detection circuit for obtaining the synchronisation signal, e.g. a zero-crossing instance of the input voltage. Such zero-crossing detection can e.g. be realised by a PLL (phase-locked loop) detection of the periodic input voltage, e.g. in the case of an AC input voltage. The synchronisation signal (e.g. indicating a zero crossing instance or a peak value instance or a predetermined voltage level instance) is utilised in the present invention to synchronise the operation of the inverter with the periodic input voltage. It is to be noted, as will be understood by the skilled person, that such a synchronisation signal can be determined directly from the power input terminal (i.e. from the periodic input voltage) but may equally be determined from the voltage as provided at the terminals of the inverter. The voltage as provided at the terminals of the inverter can e.g. be different from the periodic supply voltage in case a rectifier is applied prior to the inverter.

The control unit is further arranged to receive an input signal representing a desired lighting characteristic at a control input of the control unit. As an example, the input signal may represent a desired brightness or desired color setting of a lighting application applying the electronic circuit. The control unit as applied in the electronic circuit according to the invention is arranged to determine a control signal based on the synchronisation signal and the input signal, the control signal being applied to enable the inverter to power, in operation, a fluorescent lamp. The control signal is provided, in operation, to an enabling input of the inverter via a control output of the control unit. Such a control unit (or controller) can e.g. comprise an analogue or digital controller or a microprocessor. As an example, the control signal can comprise a first signal, e.g. a control pulse, which enables the inverter to start oscillating at its natural frequency. Due to the input of the synchronisation signal, the powering of a fluorescent lamp can be synchronised with the periodic input voltage. Based on the input signal representing the desired lighting characteristic, the power as provided to a fluorescent lamp can be controlled by an appropriate control signal. This can be understood as follows: The control signal as provided at an enabling input of the inverter can, in an embodiment, enable the inverter between a first instance and a second instance. As an example, the first instance can have a delay relative to a zero-crossing instance (or peak instance) of the period input voltage, the delay being determined by the control unit, based on the input signal. By applying a delay between a zero-crossing instance (in general, the synchronisation signal) and the application of the control signal to enable the inverter, the power that, in operation, is provided by the inverter to a fluorescent lamp, can be modified: A conventional way of powering a fluorescent lamp by an inverter is to include a starter or starter switch for starting the inverter. In the present invention, no starter or starter switch is applied because the starting of the inverter is controlled by the control signal provided by the control unit. Based upon the input signal representing the desired lighting characteristic and the synchronisation signal, the control unit controls the instance when the inverter starts oscillating (and thus provides power to the fluorescent lamp). In an embodiment, the inverter will, in operation, continue to power the fluorescent lamp until a second instance. At the second instance, the inverter will cease to provide power to the fluorescent lamp. In an embodiment, the second instance corresponds to a next zero-crossing of the periodic input voltage. As an alternative, the second instance is equally controlled by the control unit. The electronic circuit according to the present invention thus enables starting and stopping an inverter for powering a fluorescent lamp during part or all of a period of a periodic input voltage (e.g. a (rectified) AC input voltage). In the case of a 50 Hz AC input voltage, such a period would have a duration of 10 ms. In an embodiment, the control unit controls the starting instance (also referred to as the first instance) of the powering of the fluorescent lamp, while the stopping instance (also referred to as the second instance) can either be determined by the inverter design (the inverter can be designed, as is explained below, to stop powering the fluorescent lamp when, in operation, the available voltage is below a predefined level) or by the control unit, e.g. by providing a second signal at a control output of the control unit for disabling the inverter to provide power to the fluorescent lamp. By controlling the starting and stopping of the inverter of the electronic circuit, the control unit controls the inverter to operate at a certain duty cycle and thus the average power provided by the inverter. By modifying the duty cycle, e.g. in accordance with a modified input signal representing a desired lighting characteristic such as an intensity or brightness, the lighting characteristic can be altered accordingly.

In an embodiment of the electronic circuit according to the invention, the control signal as provided by the control unit comprises a control pulse, the duration of the control pulse substantially corresponding to a period of the oscillating frequency of the inverter. Compared to conventional circuits for powering a fluorescent lamp, during operation of the lamp, the inverter as applied in the electronic circuit according to the present invention stops powering a fluorescent lamp either at a zero crossing instance of the periodic input voltage (e.g. a rectified AC input voltage) or earlier. As such, the inverter should be started again each period of the periodic input voltage (e.g. once every 10 ms in the case of a 50 Hz AC voltage) in order to maintain a substantially continuous light output (as perceived by the human eye). Conventionally, when a starter or starter circuit is applied, a starting signal needs to be applied only once to start the powering of the fluorescent lamp. As the electronic circuit according to the present invention thus applies a starting signal more often, care needs to be taken not to provide too much power to start the inverter, in order not to damage it. It has been found that a control pulse having a duration substantially corresponding to a period of the oscillating frequency of the inverter is a suitable pulse for starting the inverter. Typically, such a pulse can be smaller or equal to 20 microseconds. It is to be noted that a conventional starter pulse can be much longer (e.g. several milliseconds).

The present invention further provides a lighting application comprising a fluorescent lamp unit and an electronic circuit according to the invention for driving the fluorescent lamp unit. Within the meaning of the present invention, a fluorescent lamp unit comprises one or more fluorescent lamps. In an embodiment, the lighting application according to the invention comprises a fluorescent lamp unit comprising one or more fluorescent lamps that are capacitively coupled to one or more inverters of the electronic circuit; the control unit of the electronic circuit being arranged to independently control the plurality of inverters. In such an arrangement, the control unit can ensure that each lamp operates at a different duty cycle (by controlling the starting and stopping of the inverters powering the lamps), thereby e.g. obtaining a desired lighting characteristic, such as intensity or color.

DESCRIPTION

Figure 1:
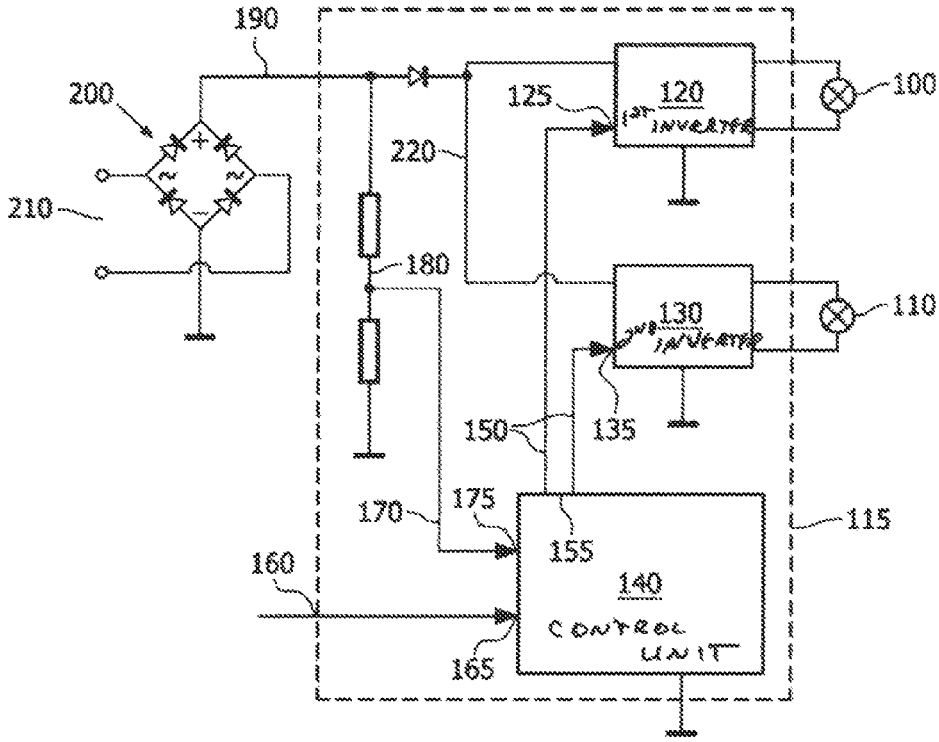
FIG. 1 schematically depicts a lighting application according to the present invention.

FIG. 1 schematically depicts an embodiment of a lighting application according to the invention. FIG. 1 schematically depicts a fluorescent lamp unit comprising a first fluorescent lamp 100 and a second fluorescent lamp 110 and an electronic circuit 115. The fluorescent lamps 100 and 110 are powered by a first inverter 120 and a second inverter 130, respectively. The embodiment as shown further comprises a control unit 140 arranged to provide a control signal 150 (via a control output 155) to an enabling input (125 and 135) of the inverters for controlling the starting of the inverters. The control unit is arranged to receive an input signal 160 at a control input 165 representing a desired lighting characteristic and a synchronisation signal 170 originating from a detection circuit 180, the detection circuit being arranged to detect a zero crossing instance of a rectified AC voltage 190 (in general, a periodic input voltage), as obtained from a rectifier 200 that is arranged to rectify an AC input voltage 210. The control unit comprises a measuring input 175 for receiving the synchronisation signal 170 (It is noted that, in an embodiment, such a measuring input 175 maybe connected directly to the periodic supply voltage (either before or after the rectifier) and applied by the control unit to determine the synchronisation signal, rather than through the application of a detection circuit 180). The control unit 140 is arranged to provide a control signal 150 to the inverter to operate the inverter in synchronism with a periodicity of the synchronisation signal 170 representing the value of the periodic input voltage, thereby using the input signal 160 and the synchronisation signal 170 for determining the control signal 150. The synchronisation signal can e.g. indicate a zero-crossing or peak instance of the periodic input voltage. The control signal 150 can e.g. (as explained in more detail in FIG. 2) comprise a pulse that is delayed with respect to a zero-crossing instance as represented by the synchronisation signal 170. Unlike conventional inverters for powering a fluorescent lamp, the inverters as applied in the present invention need not be provided with a starter or starter circuit, as the control unit is arranged to provide a control signal for starting the inverter during each period of the rectified AC voltage 190.

In order to control the power provided to the fluorescent lamps 100 and 110 during each period of the rectified AC voltage, the powering by an inverter as applied in the present invention is stopped at least at the end of each period of the rectified AC voltage. This can e.g. be achieved by an appropriate design of the inverter such that the inverter stops powering the fluorescent lamp when the voltage as provided to the inverter drops below a certain value. As an example, the inverter can be arranged to stop powering the lamp once the supply voltage 220 as provided to the inverters 120 and 130 is equal to zero. This can e.g. be realised by selecting a sufficiently small capacitance value for the capacitor C1 of the inverter shown in FIG. 2.

As an alternative, the control unit can be arranged to provide a signal to the inverter for stopping the inverter, e.g. prior to a next zero-crossing instance of the supply voltage 220. In this manner, the control unit 140 can ensure that the inverter powers the fluorescent lamp only during part (e.g. a segment) of the supply voltage 220. In such a situation, the inverter will stop powering the fluorescent lamp prior to a next zero-crossing instance. Thus, a preferred segment or part of the supply voltage can be used to power the fluorescent lamp, e.g. a central part of the supply voltage instead of the trailing part of the supply voltage.

As a result, rather than operating in a substantially continuous manner, the fluorescent lamps in the lighting application as shown in FIG. 1 can operate at a certain duty-cycle, controlled by the control unit, and are thus arranged to operate at an average power that is lower than a maximum (continuous) power. By doing so, a variation in the intensity of the light as provided by the fluorescent lamps can be realised. As will be understood by the skilled person, a color variation of the light provided by the fluorescent lamp unit can equally be provided by independently modifying the operating duty cycles (i.e. by controlling the starting and stopping of the powering by the inverters 120, 130) in case the fluorescent lamps 100, 110 of the fluorescent lamp unit have different colors. The electronic circuit 115 according to the present invention, which can be applied in a lighting application according to the present invention, enables active control of the inverter to start the lamp; instead of applying a starter circuit that is only applied once when the lamp is turned on, a control signal (e.g. a pulse) is applied each period to start the inverter (and thus the lamp), the pulse being provided each period of the rectified AC voltage, the control signal further being synchronised with the rectified AC voltage.

It will further be understood by the skilled person that the same principles also apply to fluorescent lamp units having only one lamp or more than two lamps.

Figure 2:
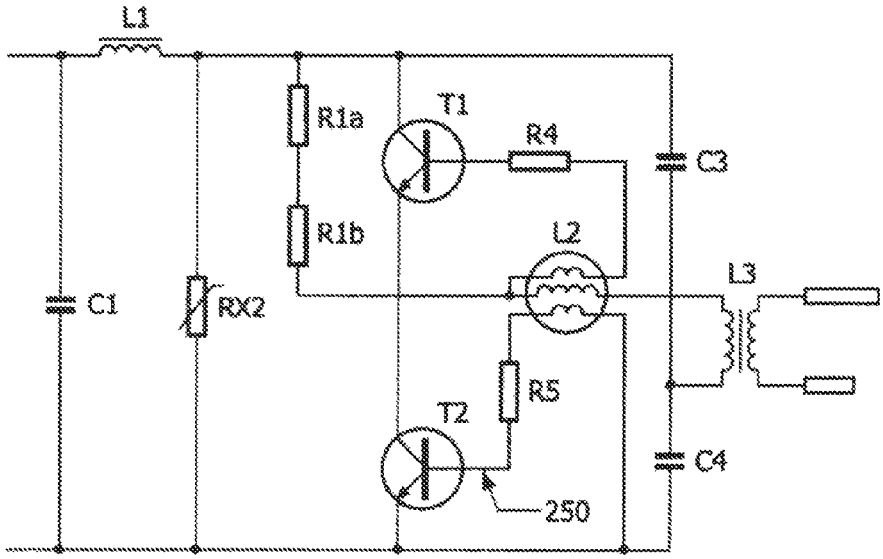
FIG. 2 schematically depicts an inverter as can be applied in an electronic circuit according to an embodiment of the invention.

FIG. 2 schematically depicts an example of an inverter that can be applied in a electronic circuit or lighting application according to the invention. The inverter as schematically depicted in FIG. 2 is a so-called toroid inverter. The inverter as shown does not comprise a start circuit that is usually found in an electronic circuit for powering a fluorescent lamp, such as a CFL (compact fluorescent lamp) driver. In order to start the inverter, a pulse output of a control unit (e.g. the control unit 140 as shown in FIG. 1) can be provided to the base of transistor T2, as indicated by the arrow 250. The emitter node of T2 is connected to a common ground. The inverter as shown further comprises a transformer with a ballast inductor integrated inside the transformer. It will be clear that such a ballast inductor can also be a separate component. In the embodiment as shown, the transformer can e.g. be applied to power a capacitively coupled fluorescent lamp, which has a lamp voltage in the order of 1 kV. In an embodiment of the present invention, a toroid inverter as illustrated in FIG. 2 is applied in the electronic circuit according to the invention. Such an inverter can be arranged to stop when the supply voltage to the inverter drops below a certain value. The supply voltage value at which the inverter is stopped can e.g. be set by an appropriate choice of resistances R4 and R5 in FIG. 2 or an appropriate selection of the winding ratio of transformer L2 in FIG. 2. The stopping of the inverter can equally be influenced by applying resistances in series with the emitters of transistors T1 and T2.

Figure 3:
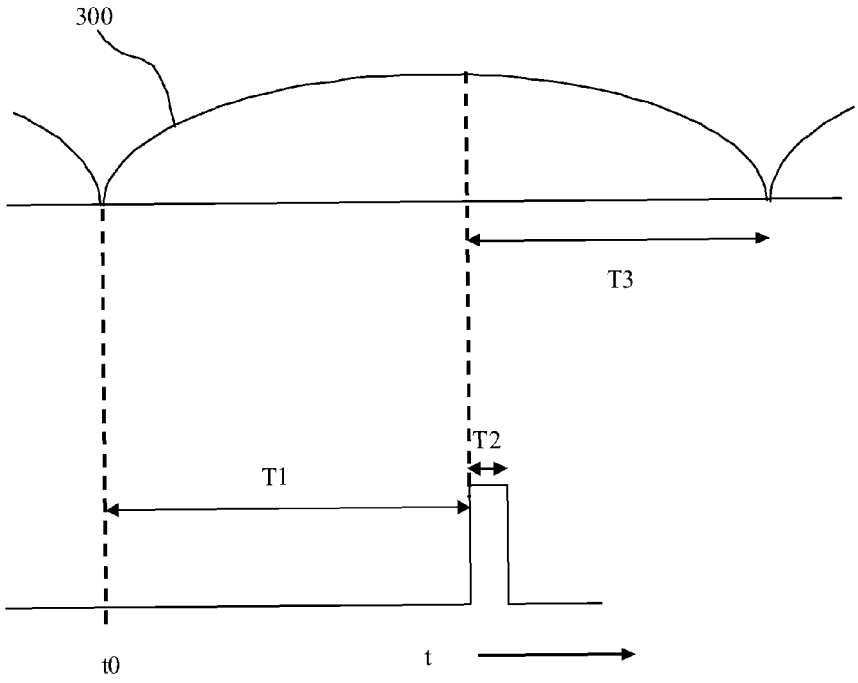
FIG. 3 schematically illustrates the operation of a control unit as can be applied in the present invention to control an inverter.

A possible timing of a control signal, such as e.g. provided by a control circuit to control an inverter, is schematically indicated in FIG. 3. FIG. 3 schematically depicts a rectified AC voltage 300 as a function of time t, wherein a zero-crossing instance t0 in the rectified AC voltage 300 is detected and after some time interval T1 a pulse of width T2 is generated by the control unit to start an inverter. (the term zero-crossing instance is applied here to indicate an instance when an input voltage substantially attains a voltage level equal to zero) The interval T1 (i.e. a delay with respect to the zero-crossing instance occurring at t0) can e.g. be determined on the basis of an input signal representing a desired lighting characteristic such as a desired light intensity. Due to the pulse, an inverter can start delivering power to a fluorescent lamp or lamp unit. The powering can e.g. be maintained until a next zero-crossing instance when the inverter is stopped, i.e. a fluorescent lamp that is in operation is thus being powered during the interval T3. This process is then repeated at a rate of e.g. 100 Hz (in case the rectified AC voltage originates from a 50 Hz AC voltage). In this way, the energy delivered in one period (of 10 ms) is regulated and consequently the lamps can e.g. be dimmed. The (user) input signal as translated by the control unit into a time shift T1 can be different for each lamp in case multiple lamps are powered. The user input signal can be, e.g. the angle of a potentiometer, a Zigbee control signal or an IR signal. Furthermore, it can also be a measured phase angle from a wall or cord dimmer as found in consumer homes. In this way, no extra interfacing to a lamp is necessary.

The pulse width T2 as applied to start an inverter to power a fluorescent lamp should be sufficiently wide to start the inverter, but should not be too wide as this could damage the inverter due to the frequent application of the pulse (e.g. once every 10 ms). Preferably, the pulse width substantially corresponds to one period of the oscillating frequency of the inverter.

Figure 4:
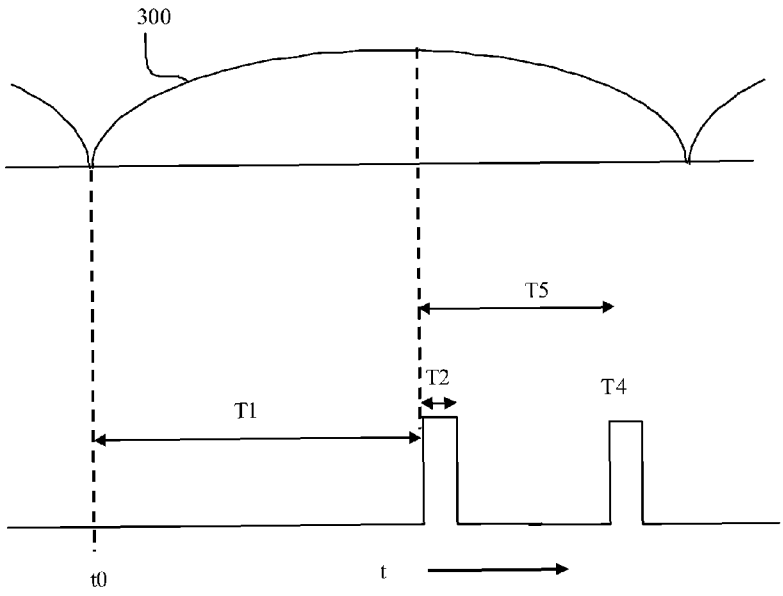
FIG. 4 schematically illustrates a further operation of a control unit as can be applied in the present invention to control an inverter.

As already mentioned above, an inverter as applied in an electronic circuit according to the invention can be arranged to stop powering a fluorescent lamp when a next zero-crossing instance occurs or when the supply voltage of the inverter (e.g. the rectified AC voltage 300 as shown in FIG. 3) drops below a certain level. As an alternative, as depicted in FIG. 4, the control unit can control the inverter (by providing a control signal such as a pulse T4) to stop powering the inverter prior to a next zero-crossing instance, thus powering a fluorescent lamp during the interval T5 rather than the interval T3 as depicted in FIG. 3. In practice, this can e.g. be realised by grounding the base of the transistor T2 of the inverter shown in FIG. 2 (thereby short-circuiting the base and emitter of the transistor). This can e.g. be done by a switch such as a bipolar transistor or a FET.

The present invention provides a low-cost solution for dynamically controlling and powering fluorescent lamps. The invention can be applied in any field where the light output of one or more capacitively coupled fluorescent lamps should be controlled depending on a user input. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The invention claimed is:

1. An electronic circuit for driving a fluorescent lamp from a periodic input voltage provided at a power input terminal, the circuit comprising an inverter for powering the fluorescent lamp;

a control unit comprising a measuring input connected to the power input terminal for providing a synchronisation signal representing a value of the periodic input voltage to the control unit, a control input for receiving an input signal representative of a desired lighting characteristic of the fluorescent lamp, and a control output connected to an enabling input of the inverter, wherein, the control unit being arranged to provide, via the control output, a control signal to the inverter to operate the inverter in synchronism with a periodicity of the synchronisation signal representing the value of the periodic input voltage, the control signal being based on the input signal;

wherein the control signal comprises a control pulse, the duration of the control pulse substantially corresponding to a period of an oscillating frequency of the inverter; and, wherein the control signal enables the inverter between a first instance relative to the zero-crossing instance and a second instance.

2. The electronic circuit according to claim 1, wherein the synchronisation signal indicates a zero-crossing instance of the periodic input voltage.

3. The electronic circuit according to claim 2, wherein the synchronisation signal is obtained from a detection circuit.

4. The electronic circuit according to claim 1, wherein the first instance has a delay relative to the zero-crossing instance, the delay being determined by the control unit, based on the input signal.

5. The electronic circuit according to claim 1, wherein the second instance corresponds to a next zero-crossing instance of the periodic input voltage.

6. The electronic circuit according to claim 1, wherein the control signal comprises a second signal for disabling the inverter as from the second instance.

7. The electronic circuit according to claim 1, wherein the inverter is a self-oscillating toroid inverter.

8. The electronic circuit according to claim 7, wherein a ballast inductor of the inverter is integrated in a transformer of the toroid inverter.

9. The electronic circuit according to claim 1, wherein the input signal is provided by a user interface such as a dimmer circuit.

10. The electronic circuit according to claim 1, wherein the lighting characteristic comprises an intensity set point and/or a color set point.

11. The electronic circuit according to claim 1, the electronic circuit comprising a plurality of inverters, the control unit being arranged to independently control the plurality of inverters.

12. A lighting application comprising a fluorescent lamp unit and an electronic circuit for driving the fluorescent lamp unit according to claim 1.

13. The lighting application according to claim 12, wherein the fluorescent lamp unit is capacitively coupled to the electronic circuit.

14. The lighting application according to claim 12, wherein the fluorescent lamp unit comprises a plurality of fluorescent lamps, each lamp being capacitively coupled to an inverter of a plurality of inverters of the electronic circuit.

15. The lighting application according to claim 14, wherein the control unit is arranged to independently control the plurality of inverters coupled to the plurality of fluorescent lamps.

16. An electronic circuit for driving a fluorescent lamp from a periodic input voltage provided at a power input terminal, the circuit comprising inverter for powering the fluorescent lamp;

a control unit comprising a measuring input connected to the power input terminal for providing a synchronisation signal representing a value of the periodic input voltage to the control unit, a control input for receiving an input signal representative of a desired lighting characteristic of the fluorescent lamp, and a control output connected to an enabling in it of the inverter, wherein, the control unit being arranged to provide, via the control output, a control signal to the inverter to operate the inverter in synchronism with a periodicity synchronisation signal representing the value of the periodic input voltage, the control signal being based on the input signal;

wherein the control signal comprises a control pulse, the duration of the control pulse substantially corresponding to a period of an oscillating frequency of the inverter; and, wherein, in operation, the control signal is provided to the inverter during each period of periodic input voltage.

* * * * *